US006951313B2

(12) United States Patent
Frick et al.

(10) Patent No.: US 6,951,313 B2
(45) Date of Patent: Oct. 4, 2005

(54) KNIFE FOR DISK CHIP CUTTING MACHINES

(75) Inventors: Anders Frick, Iggesund (SE); Mats Engnell, Iggesund (SE)

(73) Assignee: Iggesund Tools AB, Iggesund (SE)

( * ) Notice: Subject to any disclaimer, the term of this patent is extended or adjusted under 35 U.S.C. 154(b) by 0 days.

(21) Appl. No.: 10/330,266

(22) Filed: Dec. 30, 2002

(65) Prior Publication Data

US 2003/0089213 A1 May 15, 2003

Related U.S. Application Data

(62) Division of application No. 08/765,267, filed on Dec. 20, 1996, now Pat. No. 6,722,595.

(30) Foreign Application Priority Data

Jun. 29, 1994 (SE) ..... 9402310

(51) Int. Cl.[7] ..... B02C 18/18; B27L 11/00

(52) U.S. Cl. ..... 241/92; 241/298; 144/218; 144/241; 407/114; 407/116

(58) Field of Search ..... 83/592; 144/114.1, 144/162.1, 176, 218, 235, 241, 359; 241/92, 278.1, 292.1, 296, 298; 407/40, 47, 53, 61, 113–117

(56) References Cited

U.S. PATENT DOCUMENTS 4,047,670 A * 9/1977 Svensson ..... 241/92
4,164,329 A * 8/1979 Higby ..... 241/296 X
4,269,244 A * 5/1981 Kinsella ..... 144/218
4,545,413 A * 10/1985 Sundberg et al. ..... 144/176
4,669,516 A * 6/1987 Carpenter et al. ..... 241/92 X
4,694,995 A * 9/1987 Holmberg et al. ..... 241/92
4,754,789 A * 7/1988 Jonsson ..... 241/92 X
5,183,089 A * 2/1993 Norlander et al. ..... 144/241 X
5,348,065 A * 9/1994 Meyer ..... 144/241 X
5,564,967 A * 10/1996 Jorgensen ..... 451/45

FOREIGN PATENT DOCUMENTS

| | | | |
|---|---|---|---|
| AT | 397 629 | * | 5/1994 |
| DE | 1 106 483 | * | 5/1961 |
| SE | 448 842 | * | 3/1987 |

* cited by examiner

*Primary Examiner*—Clark F. Dexter
(74) *Attorney, Agent, or Firm*—Fitzpatrick Cella Harper & Scinto

(57) ABSTRACT

A knife for a disk chip cutting machine which is mounted between a carrier part and a clamping part and which includes a chip breaking surface extending into an opening adjacent an outer surface of the carrier part. The chip breaking surface includes a concave portion which terminates in a rib which extends outwardly and downwardly with respect to an interface between the knife and the carrier part with the concave portion being oriented to direct cut chips in a direction away from the outer surface of the carrier part during use.

3 Claims, 1 Drawing Sheet

KNIFE FOR DISK CHIP CUTTING MACHINES

This is a division of application Ser. No. 08/765,267 filed Dec. 20, 1996, now U.S. Pat. No. 6,722,595.

BACKGROUND OF THE INVENTION

1. Field of the Invention

The present invention relates to a knife for disk type chip cutter machines with a circular rotatable cutter disk on its first axial side being provided with several knifes running from the disk center to its periphery and an opening being provided in the disk in connection with each knife. The opening having a chip guiding surface to guide separated chips to the other axial cutter disk side and the knife comprises a knife carrier, on which the knife is fixed between a first carrier part provided essentially in line with the first axial cutter disk surface and second carrier par extending downwards in the opening from said cutter disk surface into the cutter disk inside and being a part of the chip guiding device.

2. History of the Related Art

In such knives with the knife fixed between two parts, one of which serves as a chip guide through the opening in the cutter disk a fast and heavy wear occurs of said last mentioned part, when the chips are hitting the part and when hard impurities accompanying the chips are hitting the part.

Several attempts have been made to solve this problem by means of exchangeable wear plates provided at the carrier part as part of the chip guide. All so far known devices, however, involve an increased cost during manufacturing and during an exchange of worn parts.

OBJECT OF THE INVENTION

The main objective of the present invention is to provide a knife, where the problems of the guiding surface wear is solved in a simple and economical way.

This and other objectives of the invention are achieved by providing it with the characteristics specified in the claims which follow.

BRIEF DESCRIPTION OF THE DRAWINGS

The invention will be described hereinafter more in detail in connection with the accompanying drawing, where.

DESCRIPTION OF THE PREFERRED EMBODIMENT

Figure 1:
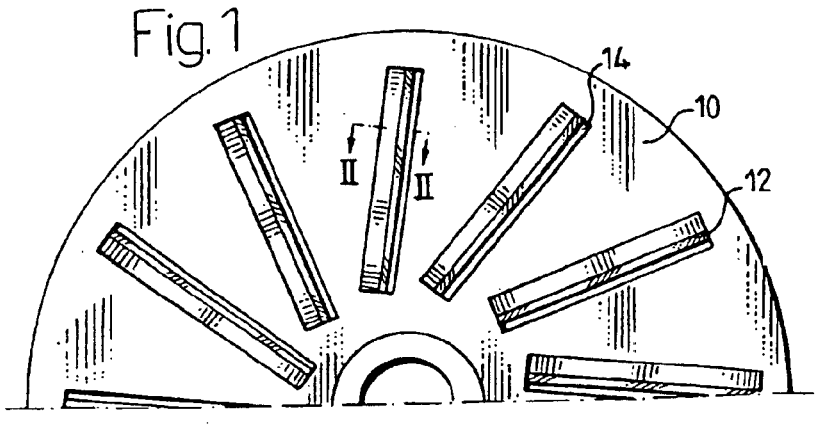
FIG. 1 shows a plane view of a part of a cutter disk with inserted knives.

In FIG. 1 a part of a cutter disk 10 is shown, mounted on which are several knives 12 extending from the disk's 10 center towards its circumference. Connected with each knife are openings 14 in the disk, through which the cut chips pass from the disk's 10 one axial surface to its opposite surface.

Figure 2:
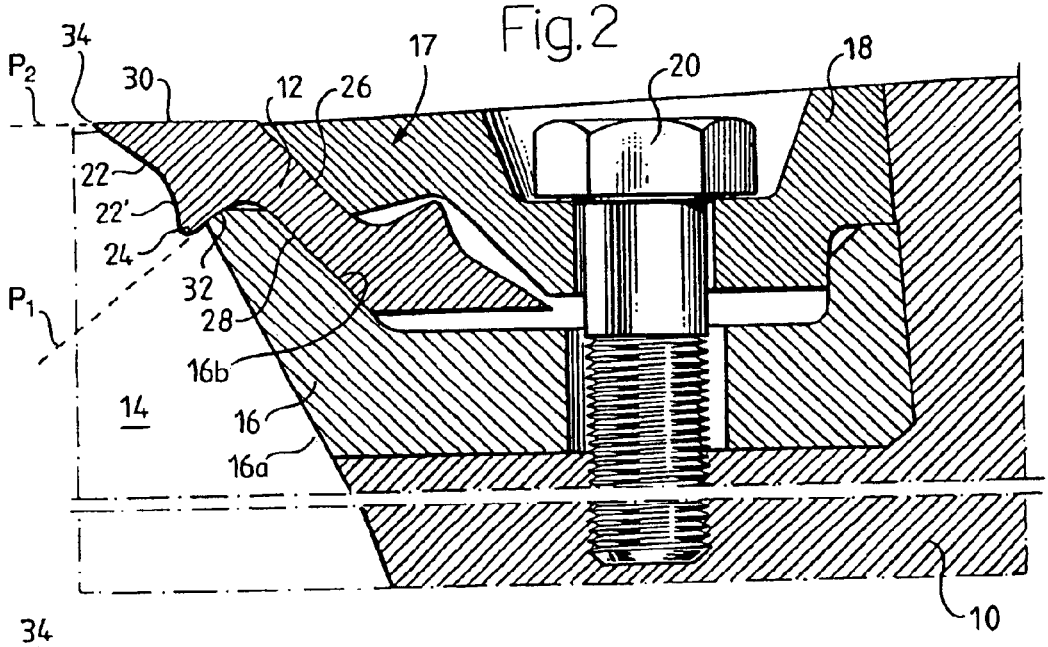
FIG. 2 shows a section through a knife according to the invention along line II—II in FIG. 1.
Figure 3:
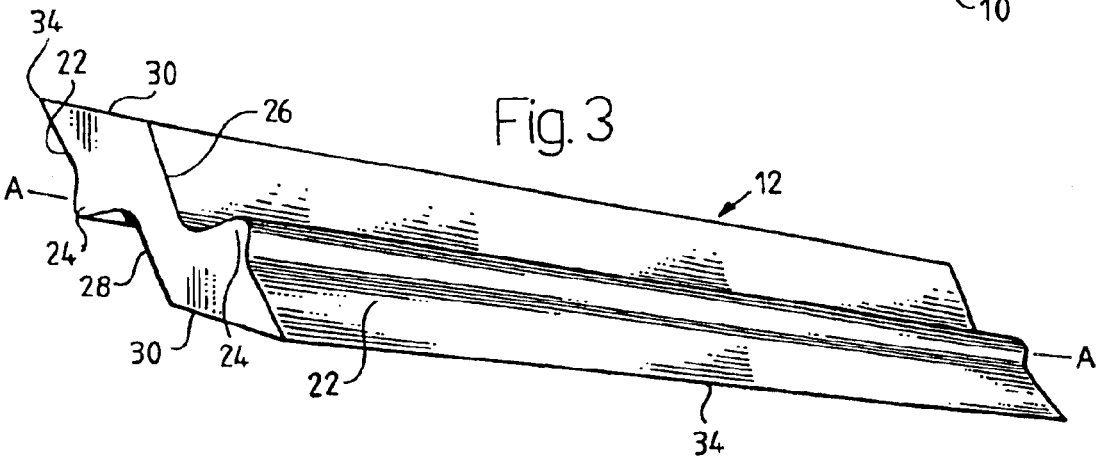
FIG. 3 is a perspective view of the knife of the invention.

In FIG. 2 the knife according to the invention is shown in section illustrating the fixing of the knife 12 in a cartridge or knife holder 17 arranged in a recess in the cutter disk 10. The cartridge consists of a carrier part 16 and a fixing or clamping part 18 keeping the knife fixed between them by means of a bolt 20 passing through openings in the cartridge parts 16 and 18, respectively. Normally, the lower carrier part 16 of the cartridge also provides the chip guide and is thus exposed to heavy wear resulting in an exchange with relatively small intervals. This part 16 due to its function as a carrier part having a special form requiring a machining during manufacturing is relatively expensive and the need to change this part within small intervals increases the service costs for the cutter.

According to the invention, another way is shown to solve the described problem. The knife 12 being preferably reversible is of course exposed to a heavy wear and is thus reversed and exchanged, respectively, to be reground or changed. To minimize the chip chocks against the lower carrier part 16 and the wear of it, the knife 12 according to the invention is provided with a chip breaking surface 22 guiding the cut chips in a direction away from the carrier part 16, particularly the outer surface 16*a* thereof, and from the cutter disk's 10 underlying surface. For example, chip breaking surface 22 is provided with a chip directing portion 22' that forms a rib or a protrusion 24 extending beyond the carrier part 16 into opening 14 when the knife 12 is in a fixed position in the cartridge, so that the chips or splinters definitely receive a motion direction leading away from the carrier part 16 and the cutter disk 10.

As shown in FIG. 2 the knife 12 has two parallel plane contact surfaces 26, 28 in contact with corresponding surfaces on the carrier part 16 and the fixing part 18 to fix the knife into the cartridge. The knife edge or cutting edge 34 is provided by a plane outer surface or knife edge forming surface 30 essentially coinciding with the cutter disks' 10 axial surface, and the previously described chip breaking surface 22—in the execution example shown first running straight and thereafter changing into a slightly concave shape to provide the guide surface 22' for the chips or splinters. The chip breaking surface 22 is, by means of the rib 24, connected or interfaced to a plane surface 32 supported by a corresponding load bearing contact surface 16*b* of the carrier part 16 providing a support for the knife 12 when under load. It should be noted that the plane surface 32 is not parallel to plane surface 30 such that the plane surface 32 diverges outwardly along a plane $P_1$ from a plane $P_2$ which coincides with the surface 30 so that cut chips are directed away from the carrier part 16. In this manner, the plane $P_1$ defined by the rib 24 extends transversely with respect to the plane $P_2$. The knife 12 is, as mentioned, reversible in that it is symmetric around an elongated axis A—A parallel to the knife edges and situated centrally inbetween these, the knife then being identically uniform after it is reversed by a half a turn around said axis.

By providing a chip breaking surface 22 according to the invention on the knife itself large saving are made in the service costs, in that the cartridge carrier part 16 and the cutter disk 10 to a great extent are protected against wear. The wear thus occurs on the knife surfaces 22 and 22', this being of minor importance, as the knife 12 in any case has to be reversed or changed, when the edge becomes dull.

Evidently the embodiment shown and described above is only one example of the implementation of the invention and this can be changed and modified within the scope of the claims which follow.

What is claimed is:

1. A knife for use with a rotary cutter disk having first and second surfaces with at least one opening therethrough which defines a passageway through the disk from said first to said second surfaces for cut chips to pass therethrough and a knife holder mounted adjacent to said opening, said knife comprising, a knife body having a first knife edge forming surface and a chip breaking surface associated with the first knife edge forming surface and extending at an angle thereto, said first knife edge forming surface and said chip breaking surface intersecting to define a cutting edge, and a rib projecting from said body parallel to and spaced from said cutting edge below said knife edge forming surface, said chip breaking surface including a planar portion that, at approximately a central portion of said chip breaking surface, transitions to a continuously smoothly curved generally concave chip directing portion, said planar portion extending from said cutting edge at an acute angle with respect to said knife edge forming surface and extending to said concave chip directing portion, said rib having (i) a first, chip directing portion which defines said chip directing portion of the knife extending outwardly from said planar portion of said chip breaking surface generally along a first plane which is transverse to a second plane defined by said first knife edge forming surface and (ii) a first knife support surface oriented along a third plane which diverges outwardly from the knife body, behind said chip deflecting surface and at an acute angle to said chip deflecting surface, said acute angle being defined substantially within the rib between said first and third planes, said first knife support surface and said chip deflecting surface converging to form a tip portion of said rib, said first and third planes intersecting substantially at said tip portion, and said second and third planes intersecting at a point located within the area of a projection of the knife onto said second plane and outside the area occupied by the knife.

2. The knife for use with the rotary cutter disk of claim 1 including a second cutting edge extending from an opposite side of the knife, said second cutting edge being defined between a second knife edge forming surface of said knife body and a second chip breaking surface of said knife body.

3. The knife for use with the rotary cutter disk of claim 2 wherein each of said cutting edges is oriented generally parallel to an elongated axis extending parallel to said cutting edges and located equal distance intermediate said cutting edges.

* * * * *

UNITED STATES PATENT AND TRADEMARK OFFICE

CERTIFICATE OF CORRECTION

PATENT NO. : 6,951,313 B2
APPLICATION NO. : 10/330266
DATED : October 4, 2005
INVENTOR(S) : Frick et al.

It is certified that error appears in the above-identified patent and that said Letters Patent is hereby corrected as shown below:

COLUMN 3

Line 19, "deflecting" should be deleted;

Line 20, "surface" (first occurrence) should read --directing portion-- and "deflecting surface," should read --directing portion,--.

COLUMN 4

Line 3, "deflecting surface" should read --directing portion--.

Signed and Sealed this

Eighteenth Day of March, 2008

JON W. DUDAS
*Director of the United States Patent and Trademark Office*